US006645704B1

(12) United States Patent
Levy

(10) Patent No.: US 6,645,704 B1
(45) Date of Patent: Nov. 11, 2003

(54) ANNEALING OF COLOR PHOTOTHERMOGRAPHIC IMAGING ELEMENTS FOR IMPROVED STABILITY

(75) Inventor: David H. Levy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/304,870

(22) Filed: Nov. 26, 2002

(51) Int. Cl.[7] ..... G03C 1/498; G03C 1/74

(52) U.S. Cl. ..... 430/349; 430/350; 430/353; 430/354; 430/501; 430/503; 430/543; 430/619; 430/620; 430/935

(58) Field of Search ..... 430/349, 203, 430/503, 543, 620, 935, 354, 353, 350, 501

(56) References Cited

U.S. PATENT DOCUMENTS 4,946,769 A * 8/1990 Arai et al. ..... 430/539
5,312,646 A 5/1994 Barbee et al.
5,422,235 A 6/1995 Chapman et al.
6,040,131 A * 3/2000 Elshelman et al. ..... 430/619
6,558,895 B2 * 5/2003 Uytterhoeven et al. ..... 430/619

* cited by examiner

*Primary Examiner*—Thorl Chea
(74) *Attorney, Agent, or Firm*—Chris P. Konkol

(57) ABSTRACT

The present invention is related to a method of making a color photothermographic element such as a capture film intended to be developed to yield an image by the application of heat, preferably without the addition of processing solutions. In particular, this invention relates to the annealing of a photothermographic imaging element prior to storage and use. It has been found that the use of such an annealing process improves raw stock storage and hence, the performance of color photothermographic systems.

20 Claims, No Drawings

ANNEALING OF COLOR PHOTOTHERMOGRAPHIC IMAGING ELEMENTS FOR IMPROVED STABILITY

FIELD OF THE INVENTION

This invention relates to a process of making a color photothermographic capture films. In particular, it has been found that the use of an annealing treatment reduces speed loss upon keeping and, hence, the performance of photothermographic systems.

BACKGROUND OF THE INVENTION

Photothermographic imaging elements that can be processed, after imagewise exposure, simply by heating the element are referred to as photothermographic elements. Preferably, photothermographic films do not require any processing solutions and instead contain within them all the chemistry required for development of a photographic image. Subsequent processing steps may employ liquid processing. These film chemistries are designed so that at room temperature they are inactive, but at elevated temperatures (greater than 120° C.), the film chemistries become functionally active.

The conventional manufacture of conventional films typically involves drying of the imaging element at elevated temperatures. The intent in such a manufacturing step is not for the film material itself to reach a high temperature which is prevented by evaporative cooling of the film, such that the film is substantially less than the temperature of the heat applied, for example, by convective air under carefully controlled temperature and humidity. Heat treatments in combination with very high humidity has also been proposed for promoting hardening prior to rolling the film sheet.

It is also known that in conventional films the gelatin contained therein is affected by temperature and humidity. The reason for this is that when the gelatin in a conventional film is contacted with an environment containing moisture, such as air at a given relative humidity, the gelatin can come to equilibrium with the environment. In that process, water will be incorporated or lost from the gelatin in order to obtain this equilibrium condition. For a given sample of gelatin, a given environmental relative humidity will correspond to a given water content in the gelatin. This is the principle of a moisture content isotherm. Thus, the extent of water content in gelatin for a given environmental relative humidity can vary. It can depend upon the type of gelatin, the additional components incorporated into the gelatin, and the environmental history of the gelatin.

PROBLEM TO BE SOLVED

While conventional film does not appear to be much affected by humidity or variations in the moisture content of the product, it has been found that the storage stability of a color photothermographic film may be significantly affected by the temperature or humidity of the film during storage. It has been observed that the film properties of aqueous-based color photothermographic films, on storage, may degrade over time and exhibit a loss of photographic speed. The reasons for this speed loss may be due to several factors. Without wishing to be bound by theory, one reason may be that such films involve chemistries that are significantly more sensitive to environmental changes and which can be adversely affected by the conditions of storage. For example, in some cases, greater moisture content can be obtained in such films upon exposure to lower relative humidity, compared to conventional films.

Compared to conventional film or black-and-white film, photothermographic film requires at least three color records and all the components needed for development and image formation may be incorporated into the imaging element. Thus, there are a greater number of potentially reactive components that can prematurely react during storage. Color photothermographic films involve new chemical systems, including new and complicated combinations of components that may be subject to unpredictable or undesirable interactions, incompatibilities, and side reactions. In particular, the imaging chemistry must be designed to provide fast, high-quality latent image formation during image capture, but must not interact prematurely to any significant degree. Similarly, the film must be capable of fast development and high quality image formation during thermal processing, but the same components must not prematurely interact before the processing step. This problem is particularly acute in photothermographic films, since the components of a photothermographic film are in intimate proximity before development.

A problem in developing or designing color photothermographic films is, therefore, to obtain good raw stock keeping. It is desirable that photothermographic elements be capable of maintaining their imaging properties, including speed, during storage periods (after manufacture). This is sometimes referred to as "raw stock keeping". Ideally, film should be storage stable, under normal conditions, for 12 months, more preferably 24 months. Most ideally, films will not degrade over substantially greater time periods, involving many years, allowing great variability in the distribution of such films as well as ensuring optimal image quality for consumers. If a film unduly loses speed during storage, poor or unacceptable image formation can occur.

In summary of the above, there remains a need for a color photothermographic film that does not exhibit any significant loss of speed or other performance characteristics during raw stock keeping.

SUMMARY OF THE INVENTION

The present invention relates to a method of making an improved photothermographic element comprising a support and at least one photothermographic layer comprising a silver halide emulsion in association with at least one organic silver salt (herein meant to include both salts and ligands). In particular, it has been found that speed loss on raw stock keeping in color photothermographic film can be prevented or minimized by the use of an annealing step subsequent to coating and drying of all the imaging layers in the film and prior to image capture and development. In particular, the present invention involves treatment of a dried imaging element by heating the element such that the temperature of at least the surface thereof is 50° C. to 90° C. degrees for at least 2 seconds, resulting in a significant reduction in speed loss in the product during to raw stock keeping. Preferably a substantial portion, or at least the imaging element, or even all of the imaging element, reaches the indicated temperature.

As used herein, the "temperature of annealing" refers herein to the temperature of the means used to heat the imaging element. With a drum heater, for example, it is the drum temperature, which is about the same as the temperature of the surroundings under unwet or substantially dry conditions. In contrast to conventional drying of film, the present invention involves heating of an already dry film, although the annealing treatment, during manufacture, can occur either separately from, or in the same unit, as the final drying of the imaging element. Because, the film has been substantially dried, the difference in temperature between the surroundings and the film surface is relatively narrow, typically less the 5° C., preferably less the 3° C.

Since photothermographic films are developed by applying heat to the film, it would be expected that photothermographic films should avoid heating prior to development. In fact, photothermographic film sold in the market is often maintained under refrigeration in storage to maintain keeping. In some embodiments, a blocked developing agent is unblocked by heating and, if prematurely unblocked, can deleteriously react with silver imaging centers in the imaging layer. Therefore, it would not be expected that an annealing process involving the application of higher amounts of heat than thought necessary for drying or manufacture would actually improve keeping.

DETAILED DESCRIPTION OF THE INVENTION

The present invention is directed to a method of making a color photothermographic element comprising at least three imaging layers comprising a blocked developer, a gelatin binder, a coupler, silver halide, and at least one organic silver salt. As indicated above, the present method involves annealing the imaging element by heating such that the temperature of at least the surface of the element is at 55 to 90° C. for at least 2 seconds, resulting in a significant reduction in speed loss in the product during raw stock keeping. Preferably, the imaging element is heated to 60 to 80° C. for 4 to 30 seconds, more preferably to a temperature of 65 to 80° C. for 5 to 25 seconds, resulting in a significant reduction in reduction of speed lass in the ultimate coated layer, including both fresh speed loss and speed loss after raw stock keeping.

As indicated above, this type of heat treatment is unobvious for a thermal film since it would have been expected that for a material that is to be processed thermally, any high temperature exposure of the film would result in premature processing and resulting degradation. In fact, it has been found that if the annealing process goes above 100° C., significant loss in speed and activity of the system is obtained. On the other hand, when the annealing is below about 55° C., there is not enough thermal energy imparted to the film to promote the advantages of annealing.

Preferably, during the conditioning step, the humidity is below 50%, more preferably 0 to 40% during the annealing step. In one embodiment of the present invention, the humidity during the annealing step is between 10 and 50%. Controlling the humidity improves the annealing process.

The annealing step preferably occurs after the coating of all the imaging layers onto a support and following the drying thereof. However, especially in two-pass coating operations, a subset of all imaging layers can be annealed according to the present invention.

During commercial manufacture, imaging elements are produced in quantity in a continuous web, which is later cut into individual imaging elements for consumer use. The web, or a portion of a web, can be treated according to the present invention. Alternately, each consumer unit, or individual imaging element, can be conditioned, after it is cut from the web, before packaging. For example, the conditioning can occur during a packaging operation. The conditioning may also occur after packaging, prior to any extended storage period, if a heating technique, such as microwave radiation, can be used that is easily applied through the packaging material.

As indicated above, in some cases, annealing of underlying imaging layers can occur before annealing of later-applied imaging layers. For example, there are two pass operations where some portion of the film is dried prior to additional coating, which can be followed by annealing. For example, a magenta layer can be annealed without the yellow layer being annealed. Preferably, however, annealing is applied to the complete imaging element, meaning all the layers. In any case, an annealing step must be accomplished before packaging, storing, use and development.

The layers of the photothermographic element during manufacture are typically coated on a support by coating procedures known in the photographic art, including dip coating, air knife coating, curtain coating or extrusion coating using hoppers. If desired, two or more layers are coated simultaneously.

The annealing step can be accomplished by various means. In one embodiment, a heated surface, for example a continuous drum processor, may be used, in which a sheet of the imaging element is fully contacted with the surface of the drum for a specified period of time. Alternatively, the annealing step may be accomplished by the use of heated air, either by forced or free convection. Thus, the heating necessary for annealing may be accomplished by air handling equipment that is typically employed in conventional film manufacture, but which is now set to treat the photothermographic film according to the present method.

The annealing may also be accomplished by a radiant means. This could be a direct source of infrared radiation, or an indirect source such as microwave radiation, which produce heat by coupling with the medium to be heated.

In one embodiment of the invention, the method involves treating a color photothermographic element that comprises a red-light-sensitive silver-halide layer unit, a green-light-sensitive silver-halide layer unit, and a blue-light-sensitive silver-halide layer unit, each layer unit further comprising a light-sensitive silver-halide emulsion, a hydrophilic binder, and one or more essentially non-light sensitive organic silver salts, at least one of which functions as an oxidizing agent for the purpose of donating silver during dry thermal development, and a blocked developing agent, which process comprises heating the photothermographic element at a temperature of 55 to 90° C. for at least 2 seconds, preferably resulting in 20 to 80% reduction in speed loss in the product during the accelerated raw-stock-keeping test describe below, as will be readily understood by a skilled artisan.

A color photothermographic imaging element made in accordance with the present invention includes a gelatin vehicle for coating the light-sensitive emulsions as layers of the element. The gelatin used as a binder may be alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure, I*. Preferably at least 25 percent, more preferably 30 to 60 percent, by solid weight of gelatin is used as the vehicle. In addition to gelatin, other vehicles may be included. Up to 100 percent of other polymer vehicles may be present, including, for example, naturally occurring substances such as proteins, protein derivatives, cellulose derivatives (e.g., cellulose esters). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

A preferred embodiment of the invention relates to a process of making a photothermographic film that can be developed by a dry process, which film employs blocked developers that decomposes (i.e., unblocks) on thermal activation to release a developing agent. In dry processing embodiments, thermal activation preferably occurs at temperatures between about 80 to 180° C., preferably 100 to 160° C.

By a "dry thermal process" or "dry photothermographic" process is meant herein a process involving, after imagewise exposure of the photographic element, developing the resulting latent image by the use of heat to raise the temperature of the photothermographic element or film to a temperature of at least about 80° C., preferably at least about 100° C., more preferably at about 120° C. to 180° C., without liquid processing of the film, preferably in an essentially dry process without the application of aqueous solutions. By an essentially dry process is meant a process that does not involve the uniform saturation of the film with a liquid, solvent, or aqueous solution. Thus, contrary to photothermographic processing involving low-volume liquid processing, the amount of water required is less than 1 times, preferably less than 0.4 times and more preferably less than 0.1 times the amount required for maximally swelling total coated layers of the film excluding a back layer. Most preferably, no liquid is required or applied added to the film during thermal treatment. Preferably, no laminates are required to be intimately contacted with the film in the presence of aqueous solution.

Preferably, during thermal development an internally located blocked developing agent in reactive association with each of three light-sensitive units becomes unblocked to form a developing agent, whereby the unblocked developing agent is imagewise oxidized on development and this oxidized form reacts with the dye-providing couplers to form a dye and thereby a color image. While the formed image can be a positive working or negative working image, a negative working image is preferred.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image recording layer of the element. This, in some cases, reduces migration of certain addenda in the layers of the element.

Photothermographic elements made in accordance with the present invention are disclosed in *Research Disclosure I*. Type B elements are particularly relevant to the present invention, since the present invention, in common with Type B elements, contains in reactive association a photosensitive silver halide, a reducing agent or developer, optionally an activator, a coating vehicle or binder, and a salt or complex of an organic compound with silver ion. In these systems, this organic complex (referred to as the silver donor) is reduced during development to yield silver metal. References describing such imaging elements include, for example, U.S. Pat. Nos. 3,457,075; 4,459,350; 4,264,725 and 4,741,992. In the type B photothermographic material, it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

Thus, the preferred photothermographic element made by the present invention is a Type B element in the sense of comprising an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

In one preferred embodiment, the color photothermographic element made by the present process comprises two essentially non-light sensitive second organic silver salts, as disclosed in commonly assigned U.S. Pat. No. 6,426,181, hereby incorporated by reference in its entirety.

In a preferred embodiment, suitable organic silver salts, particularly as silver donors, include a silver salt of a compound containing an imino group. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

A second silver organic salt, or thermal fog inhibitor, may include silver salts of thiol or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole.

A second organic silver salt may be a derivative of a thionamide. Specific examples would include but not be limited to the silver salts of 6-chloro-2-mercapto benzothiazole, 2-mercapto-thiazole, naptho(1,2-d)thiazole-2(1H)-thione, 4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, a second organic silver salt is a derivative of a mercapto-triazole. Specific examples would include, but not be limited to, a silver salt of 3-mercapto-4-phenyl-1,2,4 triazole and a silver salt of 3-mercapto-1,2,4-triazole. Most preferably the second organic salt is a derivative of a mercapto-tetrazole. Specific examples include but are not limited to silver salts of 1-phenyl-5-mercapto-tetrazole, 1-(3-acetamido)-5-mercapto-tetrazole, or 1-[3-(2-sulfo) benzamidophenyl]-5-mercapto-tetrazole.

In one embodiment of the invention, the first organic silver salt is a benzotriazole or derivative thereof and the second organic silver salt is a mercapto-functional compound, preferably mercapto-heterocyclic compound. The second organic silver salt, at levels in the range of 5 to 3,000 g/mol of imaging silver, can effectively inhibit fog during thermal processing of chromogenic photothermographic films comprising a silver donor. A particularly preferred thermal fog inhibitor is 1-phenyl-5-mercapto-tetrazole (PMT).

In general, the organic silver salt form of the thermal fog inhibitor is formed by mixing silver nitrate and other salts with the free base of the PMT of the like. By raising the pH sufficiently with alkaline base, the silver salt of PMT can be precipitated, typically in spheroids 20 nm in diameter and larger. Typically, the free ligand of PMT can be ball milled to form a dispersion and added to the gelatin and silver-halide containing emulsion at a pH of 5–7.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

Dry thermal development of a color photothermographic film for general use with respect to consumer cameras provides significant advantages in processing ease and convenience, since they are developed by the application of heat without wet processing solutions. Such film is especially amenable to development at kiosks, with the use of essentially dry equipment. Thus, it is envisioned that a consumer could bring an imagewise exposed photothermographic film made by the present process, for development and printing, to a kiosk located at any one of a number of diverse locations, optionally independent from a wet-development lab, where the film could be developed and printed without requiring manipulation by third-party technicians. It is also envisioned that a consumer could own and operate such film development equipment at home, particularly since the system is dry and does not involve the application and use of complex or hazardous chemicals. Thus, the dry photothermographic system opens up new opportunities for greater convenience, accessibility, and speed of development (from the point of image capture by the consumer to the point of prints in the consumer's hands), even essentially "immediate" development in the home for a wide cross-section of consumers.

Assuming the availability and accessibility of such kiosks, such photothermographic films could potentially be developed at any time of day, "on demand," in a matter minutes, without requiring the participation of third-party processors, multiple-tank equipment and the like. Such photothermographic processing could potentially be done on an "as needed" basis, even one roll at a time, without necessitating the high-volume processing that would justify, in a commercial setting, equipment capable of high-throughput. The kiosks thus envisioned would be capable of heating the film to develop a negative color image and then subsequently scanning the film on an individual consumer basis, with the option of generating a display element corresponding to the developed color image. Details of useful scanning and image manipulation schemes are disclosed in co-filed and commonly assigned U.S. Pat. No. 6,369,873 and U.S. Ser. No. 09/592,816, both hereby incorporated by reference in their entirety.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443. Method for the scanning of such films are also disclosed in commonly assigned U.S. Ser. No. 09/855,046 and U.S. Ser. No. 09/855,051, hereby incorporated by reference in their entirety.

Photographic elements designed to be processed thermally (involving dry physical development processes) and then scanned may be designed to achieve different responses than optically printed film elements. The dye image characteristic curve gamma is generally lower than in optically printed film-elements, so as to achieve an exposure latitude of at least 2.7 log E, which is a minimum acceptable exposure latitude of a multicolor photographic element An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. For this reason, it is advantageous to control the gamma of the film to be scanned by emulsion design, laydown or coupler laydown to give two examples of useful methods, known in the art.

A typical color negative film construction made in accordance with the invention is illustrated by the following element, SCN-1:

| ELEMENT SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure I*.

Photographic elements made by the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thickness are less than 0.3 $\mu$m (most preferably less than 0.2 $\mu$m). Ultrathin tabular grain emulsions, those with mean tabular grain thickness of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure I*, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains that can be used in the invention may be prepared according to methods known in the art, such as those described in *Research Disclosure I*, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

While any useful quantity of light sensitive silver, as silver halide, can be employed in making the elements in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and. desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure I*, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units in the element made by the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptances according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure I*, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure I*, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure I*, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure I*, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (I).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to other conventional color negative constructions as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum-density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements made in accordance with the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div A$ log E) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure I*, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure*, Vol. 176, December 1978, Item 17643, XXIII. Image transfer systems.

When yellow, magenta, and cyan image dyes or other colored dyes are formed to read out the recorded scene exposures following development of a photothermographic material, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity can be made in the practice of this invention. The elements preferably have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number pH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

Photographic elements made according to the present invention are preferably imagewise exposed using any of the known techniques, including those described in *Research Disclosure I*, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

Examples of blocked developers that can be used in photographic elements of the present invention include, but are not limited to, the blocked developing agents described in U.S. Pat. No. 3,342,599, to Reeves; *Research Disclosure*

(129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. Pat. Nos. 6,395,460 and 6,306,551; U.S. application Ser. No. 09/475,703, filed Dec. 30, 1999, IMAGING ELEMENT CONTAINING A BLOCKED PHOTOGRAPHICALLY USEFUL COMPOUND; U.S. Pat. Nos. 6,426,179 and 6,312,879. Further improvements in blocked developers are disclosed in U.S. Pat. No. 6,413,708, U.S. Ser. No. 09/718,014, U.S. Pat. No. 6,319,640, and U.S. Ser. No. 09/710,348. Yet other improvements in blocked developers and their use in photothermographic elements are found in commonly assigned copending applications, filed concurrently herewith, U.S. Ser. No. 09/718,027 and U.S. Pat. No. 6,472,111, all of which are hereby incorporated by reference.

The blocked developer is preferably incorporated in one or more of the imaging layers of the imaging element. The amount of blocked developer used is preferably 0.01 to 5 $g/m^2$, more preferably 0.1 to 2 $g/m^2$ and most preferably 0.3 to 2 $g/m^2$ in each layer to which it is added. These may be color forming or non-color forming layers of the element. The blocked developer can be contained in a separate element that is contacted to the photographic element during processing.

After image-wise exposure of the imaging element, the blocked developer is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

The photothermographic element can comprise a thermal solvent. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Patent No. 4,123,282.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

After imagewise exposure of the photothermographic element, the resulting latent image can be developed in a variety of ways. The simplest is by overall heating the element to thermal processing temperature. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent application Ser. No. 09/206,586, filed Dec. 7, 1998 and U.S. Pat. Nos. 6,062,746 and 6,048,110, which are incorporated herein by reference. The use of an apparatus whereby the processor can be used to write information onto the element, information which can be used to adjust processing, scanning, and image display is also envisaged. This system is disclosed in U.S. patent applications Ser. No. 09/206,914 filed Dec. 7, 1998 and U.S. Pat. No. 6,278,510, which are incorporated herein by reference.

Thermal processing is preferably carried out under ambient conditions of pressure and humidity. Conditions outside of normal atmospheric pressure and humidity are useful.

It is contemplated that imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

PHOTOGRAPHIC EXAMPLES

Processing conditions are as described in the examples. Unless otherwise stated, the silver halide was removed after development by immersion in KODAK FLEXICOLOR Fix solution. The following components are used in the examples:

Silver Salt Dispersion SS-1

A stirred reaction vessel was charged with 480 g of lime processed gelatin and 5.6 l of distilled water. A solution containing 0.7 M silver nitrate was prepared (Solution A). A solution containing 0.7 M benzotriazole and 0.7 M NaOH was prepared (Solution B). The mixture in the reaction vessel was adjusted to a pAg of 7.25 and a pH of 8.00 by additions of Solution B, nitric acid, and sodium hydroxide as needed.

Solution A was added with vigorous mixing to the kettle at 38 cc/minute, and the pAg was maintained at 7.25 by a simultaneous addition of solution B. This process was continued until the quantity of silver nitrate added to the vessel was 3.54 M, at which point the flows were stopped and the mixture was concentrated by ultrafiltration. The resulting silver salt dispersion contained fine particles of silver benzotriazole.

Silver Salt Dispersion SS-2

A stirred reaction vessel was charged with 480 g of lime processed gelatin and 5.6 l of distilled water. A solution containing 0.7 M silver nitrate was prepared (Solution A). A solution containing 0.7 M 1-phenyl-5-mercaptotetrazole and 0.7 M NaOH was also prepared (Solution B). The mixture in the reaction vessel was adjusted to a pAg of 7.25 and a pH of 8.00 by additions of Solution B, nitric acid, and sodium hydroxide as needed.

Solution A was added to the kettle at 19.6 cc/minute, and the pAg was maintained at 7.25 by a simultaneous addition of solution B. This process was continued until the 3.54 moles of silver nitrate had been added to the vessels, at which point the flows were stopped and mixture was concentrated by ultrafiltration. The resulting silver salt dispersion contained fine particles of the silver salt of 1-phenyl-5-mercaptotetrazole.

Melt Former MF-1 Dispersion

A dispersion of salicylanilide was prepared by the method of ball milling. To a total 20 g sample was added 3.0 gm salicylanilide solid, 0.20 g polyvinyl pyrrolidone, 0.20 g TRITON X-200 surfactant, 1.0 g gelatin, 15.6 g distilled water, and 20 ml of zirconia beads. The slurry was ball milled for 48 hours. Following milling, the zirconia beads were removed by filtration. The slurry was refrigerated prior to use. For preparations on a larger scale, the salicylanilide was media-milled to give a final dispersion containing 30% Salicylanilide, with 4% TRITON X 200 surfactant and 4% polyvinyl pyrrolidone added relative to the weight of Salicylanilide. In some cases the dispersion was diluted with water to 25% Salicylanilide or gelatin (5% of total) was added and the concentration of Salicylanilide adjusted to 25%. If gelatin is added, biocide (KATHON) is also added.

Developer D-1 Dispersion

A slurry was milled in water containing developer D-1 and Olin 10 G as a surfactant. The Olin 10 G was added at a level of 10% by weight of the D-1. To the resulting slurry was added water and dry gelatin in order to bring the final concentrations to 13% D-1 and 4% gelatin. The gelatin was allowed to swell by mixing the components at 15 C for 90 minutes. After this swelling process, the gelatin was dissolved by bringing the mixture to 40C for 10 minutes, followed by cooling the chill set the dispersion.

D-1

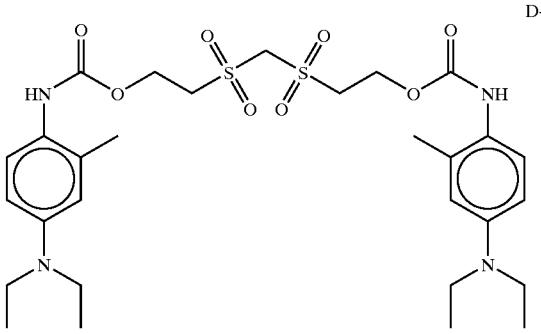

Coupler Dispersion CDM-1

An oil based coupler dispersion was prepared by conventional means containing coupler M-1 and tricresyl phosphate at a weight ratio of 1:0.5.

Coupler Dispersion DCM-1

A coupler dispersion was prepared by conventional means containing coupler M-1 at 5.5% and gelatin at 8%. The dispersion contained coupler solvents tricresyl phosphate and CS-1 at weight ratios of 0.8 and 0.2 relative to the coupler M-1, respectively.

M-1

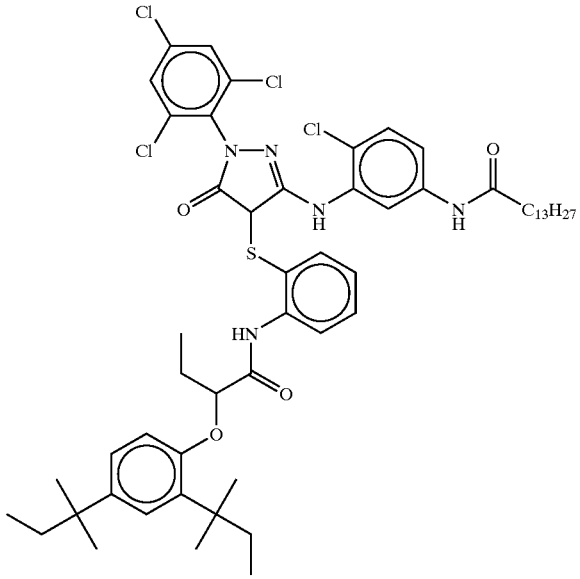

CS-1

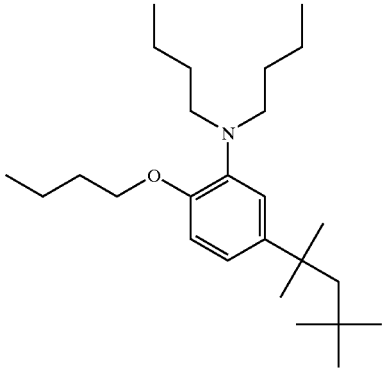

Coupler Dispersion CCD-1

An oil based coupler dispersion was prepared by conventional means containing coupler CC-1 and coupler solvent CS-2 weight ratio of 1:2.

CC-1

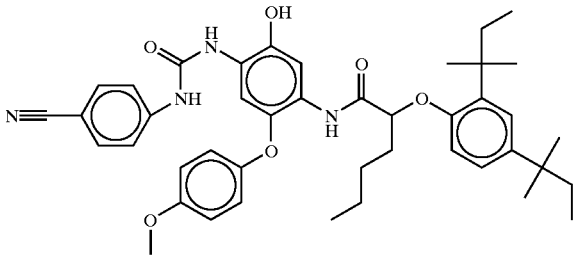

CS-2

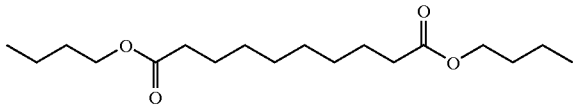

Coupler Dispersion CDY-1

An oil based coupler dispersion was prepared by conventional means containing coupler Y-1 and dibutyl phthalate at a weight ratio of 1:0.5.

YC-1

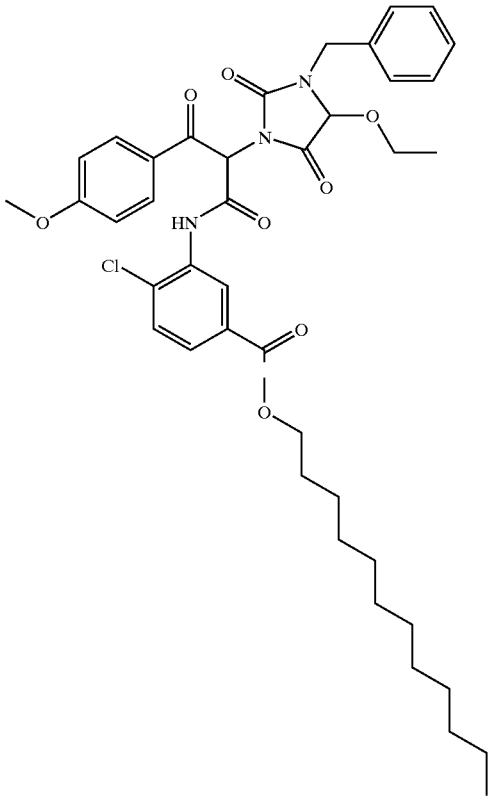

The following further components are mentioned in the later examples.

DYE-1

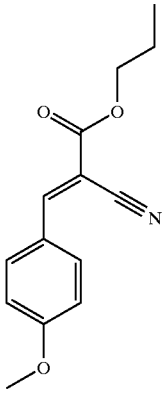

-continued

DYE-2

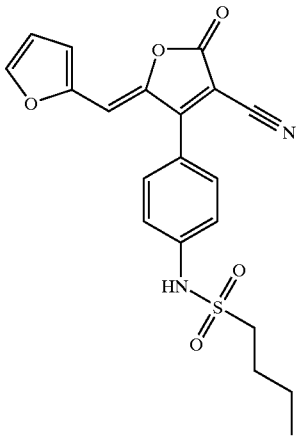

DYE-2

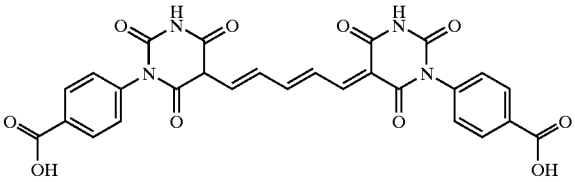

HAR-1

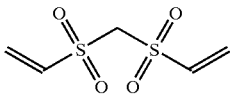

AF-1

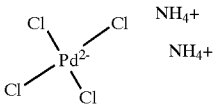

AF-2

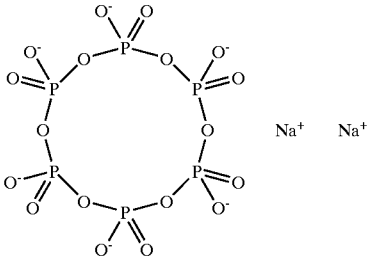

AF-3

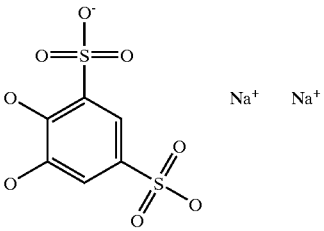

AF-4

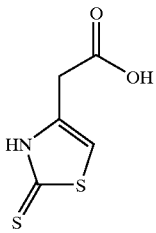

-continued

AF-5

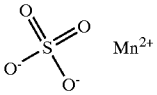

Example 1

The multilayer film as shown in Table 1 below was coated on a polyethylene terephthalate support. The coating was accomplished using an extrusion hopper that applied each layer in an independent process.

TABLE 1

| | | |
|---|---|---|
| | | Overcoat |
| 0.486 | $g/m^2$ | HAR-1 (Hardener) |
| 1.296 | $g/m^2$ | Gelatin |
| 0.03888 | $g/m^2$ | Silicone Polymer DC-200 (Dow Corning) |
| 0.1134 | $g/m^2$ | Matte Beads |
| 0.0972 | $g/m^2$ | DYE-1 (UV) |
| 0.01026 | $g/m^2$ | FC-135 Fluorinated Surfactant |
| | | Fast Yellow |
| 1.782 | $g/m^2$ | Gelatin |
| 0.1512 | $g/m^2$ | SS-1 |
| 0.1512 | $g/m^2$ | SS-2 |
| 0.216 | $g/m^2$ | YC-1 |
| 0.5184 | $g/m^2$ | MF-1 |
| 0.5184 | $g/m^2$ | D-1 |
| 0.486 | $g/m^2$ | Emulsion: 1.97 × 0.13 mm T-grain, yellow sensitized |
| | | Slow Yellow |
| 2.754 | $g/m^2$ | Gelatin |
| 0.2376 | $g/m^2$ | SS-1 |
| 0.2376 | $g/m^2$ | SS-2 |
| 0.3888 | $g/m^2$ | YC-1 |
| 0.5832 | $g/m^2$ | MF-1 |
| 0.5832 | $g/m^2$ | D-1 |
| 0.216 | $g/m^2$ | Emulsion: 1.2 × 0.1 mm T-grain, yellow sensitized |
| 0.0918 | $g/m^2$ | Emuision: 0.42 × 0.06 mm T-grain, yellow sensitized |
| 0.108 | $g/m^2$ | Emulsion: 0.68 × 0.093 mm T-grain, yellow sensitized |
| 0.0648 | $g/m^2$ | Emulsion: 0.15 m cubic, yellow sensitized |
| 0.0648 | $g/m^2$ | Emulsion: 0.13 mm cubic, yellow sensitized |
| 0.0432 | $g/m^2$ | Emulsion: 0.10 mm cubic, yellow sensitized |
| | | Interlayer |
| 1.08 | $g/m^2$ | Gelatin |
| 0.00216 | $g/m^2$ | AF-1 |
| 0.0864 | $g/m^2$ | DYE-2 (Yellow) |
| | | Fast Magenta |
| 1.782 | $g/m^2$ | Gelatin |
| 0.1512 | $g/m^2$ | SS-1 |
| 0.1512 | $g/m^2$ | SS-2 |
| 0.216 | $g/m^2$ | MC-1 |
| 0.216 | $g/m^2$ | MF-1 |
| 0.216 | $g/m^2$ | D-1 |
| 0.486 | $g/m^2$ | Emulsion: 1.97 × 0.13 mm T-grain, magenta sensitized |
| | | Slow Magenta |
| 2.754 | $g/m^2$ | Gelatin |
| 0.2376 | $g/m^2$ | SS-1 |
| 0.2376 | $g/m^2$ | SS-2 |
| 0.3888 | $g/m^2$ | MC-1 |
| 0.2376 | $g/m^2$ | MF-1 |
| 0.2376 | $g/m^2$ | D-1 |
| 0.216 | $g/m^2$ | Emulsion: 1.2 × 0.1 mm T-grain, magenta sensitized |
| 0.0918 | $g/m^2$ | Emulsion: 0.42 × 0.06 mm T-grain, magenta sensitized |
| 0.108 | $g/m^2$ | Emulsion: 0.68 × 0.093 mm T-grain, magenta sensitized |
| 0.0648 | $g/m^2$ | Emulsion: 0.15 m cubic, magenta sensitized |

TABLE 1-continued

| | | |
|---|---|---|
| 0.0648 | $g/m^2$ | Emulsion: 0.13 mm cubic, magenta sensitized |
| 0.0432 | $g/m^2$ | Emulsion: 0.10 mm cubic, magenta sensitized |
| | | Interlayer |
| 1.08 | $g/m^2$ | Gelatin |
| 0.00216 | $g/m^2$ | AF-1 |
| | | Fast Cyan |
| 1.782 | $g/m^2$ | Gelatin |
| 0.1512 | $g/m^2$ | SS-1 |
| 0.1512 | $g/m^2$ | SS-2 |
| 0.216 | $g/m^2$ | CC-1 |
| 0.5184 | $g/m^2$ | MF-1 |
| 0.5184 | $g/m^2$ | D-1 |
| 0.486 | $g/m^2$ | Emulsion: 1.97 × 0.13 mm T-grain, cyan sensitized |
| | | Slow Cyan |
| 2.754 | $g/m^2$ | Gelatin |
| 0.2376 | $g/m^2$ | SS-1 |
| 0.2376 | $g/m^2$ | SS-2 |
| 0.3888 | $g/m^2$ | CC-1 |
| 0.5832 | $g/m^2$ | MF-1 |
| 0.5832 | $g/m^2$ | D-1 |
| 0.216 | $g/m^2$ | Emulsion: 1.2 ×0.1 mm T-grain, cyan sensitized |
| 0.0918 | $g/m^2$ | Emulsion: 0.42 ×0.06 mm T-grain, cyan sensitized |
| 0.108 | $g/m^2$ | Emulsion: 0.68 ×0.093 mm T-grain, cyan sensitized |
| 0.0648 | $g/m^2$ | Emulsion: 0.15 m cubic, cyan sensitized |
| 0.0648 | $g/m^2$ | Emulsion: 0.13 mm cubic, cyan sensitized |
| 0.0432 | $g/m^2$ | Emulsion: 0.10 mm cubic, cyan sensitized |
| | | Antihalation Layer |
| 1.62 | $g/m^2$ | Gelatin |
| 0.0432 | $g/m^2$ | DYE-3 |
| 0.00756 | $g/m^2$ | AF-2 |
| 0.27 | $g/m^2$ | AF-3 |
| 0.00054 | $g/m^2$ | AF-4 |
| 0.00076 | $g/m^2$ | AF-5 |
| 0.00216 | $g/m^2$ | AF-1 |

In order to assess the usefulness of the annealing step, this coating was subjected to a variety of post coating annealing steps, including, in a comparative example, no annealing. The annealing steps were accomplished by passing the coated samples over a heated drum that rotated with the sample.

While it is desirable that films be stable over the above timeframes, it is not practical during film research and development to test new films for these long periods. As a result, during film design accelerated tests are used to predict the actual raw stock keeping of a film. Acceleration can be accomplished by varying the temperature or humidity of the keeping experiment. For the purpose of this work, a typical accelerated keeping condition would be 120° F. and 50% relative humidity. A film under such a storage condition for seven days is believed to be representative of actual film keeping for 6 months.

The above coatings were annealed by contacting the emulsion side of the coating facing the drum. The measured parameter was the loss in speed of the red record during an accelerated keeping test during which the coating was subjected to an environment of 120° F. and 50% RH (relative humidity) for 7 days, referred to as the "specified accelerated storage seven-day test." Table 2 shows the results of this accelerated testing:

TABLE 2

| Example | Annealing Step (temp/sec) | Red Channel Speed Change |
|---|---|---|
| 1-C-1 | None | −0.87 |
| 1-I-1 | 60° C./5" | −0.18 |
| 1-I-2 | 60° C./20" | 0.09 |
| 1-I-3 | 60° C./30" | 0.09 |
| 1-1-4 | 75° C./5" | −0.23 |
| 1-I-5 | 75° C./20" | 0.07 |
| 1-I-6 | 75° C./30" | 0.16 |

The speed loss is calculated as follows. For a given coating formulation, the following tests are performed:

Test 1: A test strip is processed without any keeping.

Test 2: A test strip is kept for 1 week at 120 F/50% RH and then processed.

Immediately prior to processing, Test 1 and Test 2 strips are exposed to a step wedge target at a given exposure. After thermal processing, densitometer measurement allows a D-Log(E) to be created. A speed point for each condition is then determined as the exposure that produces and image density of 0.15 density units above Dmin. The speed loss upon keeping is then obtained as the difference between "Test 1" and "Test 2" speed points. In the case of an annealed coating, the annealing step is performed prior to any keeping experiments.

Table 2 clearly shows that while a substantial speed loss is experienced by the comparative coating that did not receive an annealing step, all of the imaging layers subjected to an annealing step according to the present invention showed significant improvements (decrease) in this speed loss.

Example 2

The multilayer film as shown in Table 3 below was coated on a polyethylene terephthalate support. The coating was accomplished using a slide hopper capable of coating several layers on each coating pass. The overall coating was accomplished in 3 passes.

TABLE 3

| | | |
|---|---|---|
| | | Overcoat |
| 1.08 | $g/m^2$ | Gelatin |
| | | Fast Yellow |
| 1.78 | $g/m^2$ | Gelatin |
| 0.17 | $g/m^2$ | SS-1 |
| 0.17 | $g/m^2$ | SS-2 |
| 0.29 | $g/m^2$ | YC-1 |
| 0.46 | $g/m^2$ | MF-1 |
| 0.46 | $g/m^2$ | D-1 |
| 0.86 | $g/m^2$ | Emulsion: 1.97 × 0.13 mm T-grain, yellow sensitized |
| | | Slow Yellow |
| 0.48 | $g/m^2$ | HAR-1 |
| 2.70 | $g/m^2$ | Gelatin |
| 0.28 | $g/m^2$ | SS-1 |
| 0.28 | $g/m^2$ | SS-2 |
| 0.46 | $g/m^2$ | YC-1 |
| 0.75 | $g/m^2$ | MF-1 |
| 0.75 | $g/m^2$ | D-1 |
| 0.43 | $g/m^2$ | Emulsion: 1.2 × 0.1 mm T-grain, yellow sensitized |
| 0.22 | $g/m^2$ | Emulsion: 0.42 × 0.06 mm T-grain, yellow sensitized |
| 0.22 | $g/m^2$ | Emulsion: 0.68 × 0.093 mm T-grain, yellow sensitized |
| 0.11 | $g/m^2$ | Emulsion: 0.15 m cubic, yellow sensitized |

TABLE 3-continued

| | | |
|---|---|---|
| 0.11 | $g/m^2$ | Emulsion: 0.13 mm cubic, yellow sensitized |
| | | Interlayer |
| 1.08 | $g/m^2$ | Gelatin |
| 0.0022 | $g/m^2$ | AF-1 |
| 0.06 | $g/m^2$ | DYE-2 (yellow) |
| | | Fast Magenta |
| 1.78 | $g/m^2$ | Gelatin |
| 0.17 | $g/m^2$ | SS-1 |
| 0.17 | $g/m^2$ | SS-2 |
| 0.29 | $g/m^2$ | MC-1 |
| 0.38 | $g/m^2$ | MF-1 |
| 0.38 | $g/m^2$ | D-1 |
| 0.86 | $g/m^2$ | Emulsion: 1.97 × 0.13 min T-grain, magenta sensitized |
| | | Slow Magenta |
| 2.70 | $g/m^2$ | Gelatin |
| 0.28 | $g/m^2$ | SS-1 |
| 0.28 | $g/m^2$ | SS-2 |
| 0.29 | $g/m^2$ | MC-1 |
| 0.59 | $g/m^2$ | MF-1 |
| 0.59 | $g/m^2$ | D-1 |
| 0.43 | $g/m^2$ | Emulsion: 1.2 × 0.1 mm T-grain, magenta sensitized |
| 0.22 | $g/m^2$ | Emulsion: 0.42 × 0.06 mm T-grain, magenta sensitized |
| 0.22 | $g/m^2$ | Emulsion: 0.68 × 0.093 mm T-grain, magenta sensitized |
| 0.11 | $g/m^2$ | Emulsion: 0.15 m cubic, magenta sensitized |
| 0.11 | $g/m^2$ | Emulsion: 0.13 mm cubic, magenta sensitized |
| | | Interlayer |
| 1.08 | $g/m^2$ | Gelatin |
| 0.0022 | $g/m^2$ | AF-1 |
| | | Fast Cyan |
| 1.78 | $g/m^2$ | Gelatin |
| 0.17 | $g/m^2$ | SS-1 |
| 0.17 | $g/m^2$ | SS-2 |
| 0.29 | $g/m^2$ | CC-1 |
| 0.46 | $g/m^2$ | MF-1 |
| 0.46 | $g/m^2$ | D-1 |
| 0.86 | $g/m^2$ | Emulsion: 1.97 × 0.13 mm T-grain, cyan sensitized |
| | | Slow Cyan |
| 2.70 | $g/m^2$ | Gelatin |
| 0.28 | $g/m^2$ | SS-1 |
| 0.28 | $g/m^2$ | SS-2 |
| 0.46 | $g/m^2$ | CC-1 |
| 0.75 | $g/m^2$ | MF-1 |
| 0.75 | $g/m^2$ | D-1 |
| 0.43 | $g/m^2$ | Emulsion: 1.2 × 0.1 mm T-grain, cyan sensitized |
| 0.22 | $g/m^2$ | Emulsion: 0.42 × 0.06 mm T-grain, cyan sensitized |
| 0.22 | $g/m^2$ | Emulsion: 0.68 × 0.093 mm T-grain, cyan sensitized |
| 0.11 | $g/m^2$ | Emulsion: 0.15 m cubic, cyan sensitized |
| 0.11 | $g/m^2$ | Emulsion: 0.13 mm cubic, cyan sensitized |
| | | Antihalation Layer |
| 1.62 | $g/m^2$ | Gelatin |
| 0.03 | $g/m^2$ | DYE-3 |
| 0.0076 | $g/m^2$ | AF-2 |
| 0.27 | $g/m^2$ | AF-3 |
| 0.00054 | $g/m^2$ | AF-4 |
| 0.00076 | $g/m^2$ | AF-5 |
| 0.00216 | $g/m^2$ | AF-1 |

In order to assess the affect of the annealing step, this coating was subjected to a variety of post-coating annealing steps, including no annealing as the comparative example. The coated samples consisted of a roll of film that had been coated and dried several days prior to the test. The annealing steps were accomplished by passing the coated samples over a heated drum that rotated with the sample. It can be assumed that under such conditions, the temperature of at least the surface of the sample attains the temperature of the heated drum within 1° C. or less. The coatings were contacted with the emulsion side of the coating facing the drum. The measured parameter was the loss in speed of the red record during an accelerated keeping test during which the coating was subjected to an environment of 120° F. and 50% RH for 7 days. Table 4 below shows the results of this testing:

TABLE 4

| Example | Annealing Step | Red Channel Speed Change |
|---|---|---|
| 1-C-1 | None | −1.23 |
| 1-I-1 | 60° C./5" | −0.89 |
| 1-I-2 | 60° C./20" | −0.30 |
| 1-I-3 | 60° C./30" | −0.24 |
| 1-I-4 | 75° C./5" | −0.95 |
| 1-I-5 | 75° C./20" | −0.48 |
| 1-I-6 | 75° C./30" | −0.43 |

Table 4 clearly shows that while a substantial speed loss is experienced by the comparative coating that did not receive an annealing step, all of the coatings subjected to annealing steps showed significant improvements (decrease) in this speed loss. This example demonstrates that even though the manufacturing process for Example 2 is very different than for Example 1, the improvement in coating response is still seen with an annealing treatment.

The invention has been described in detail with particular reference to certain preferred embodiments thereof, but it will be understood that variations and modifications can be effected within the spirit and scope of the invention.

What is claimed is:

1. A method of making a color photothermographic element comprising a red-light-sensitive silver-halide layer unit, a green-light-sensitive silver-halide layer unit, and a blue-light-sensitive silver-halide layer unit, each layer unit further comprising a light-sensitive silver-halide emulsion, a gelatin binder, at least one essentially non-light sensitive organic silver salt that functions as an oxidizing agent for the purpose of donating silver during dry thermal development, and a developing-agent precursor, which element is developed by heating to a temperature of 120 to 180° C., which method comprises annealing by heating at least one imaging layer in the color photothermographic element such that the surface of the element attains a temperature of at least 55° C. for at least 2 seconds at a relative humidity of less than 50%, wherein the annealing occurs after the imaging layer is substantially dried but before image capture.

2. The method of claim 1 wherein, before annealing, the film has a loss of speed according to a specified accelerated-keeping seven-day test and, after annealing, the film has less than 80 percent of said loss of speed.

3. The method of claim 1 wherein, before annealing, the film has a loss of speed according to a specified accelerated-keeping seven-day test and, after annealing, the film has 20 to 80 percent of said loss of speed.

4. The method of claim 1 wherein the difference between said surface temperature and the heat applied is less than 3° C.

5. The method of claim 1 wherein all the layers of the photothermographic element are annealed.

6. The method of claim 1 wherein all imaging layers in at least one color layer unit are annealed.

7. The method of claim 1 wherein all imaging layers in at least the green color layer unit are annealed.

8. The method of claim 1, the photothermographic element further comprising a coupler in each imaging layer thereof.

9. The method of claim 1, wherein said annealing comprises heating at least one imaging layer in the color photothermographic element such that the surface of the element attains a temperature of at least 55° C. for at least 2 seconds.

10. The method of claim 1, wherein said annealing comprises heating at least one imaging layer in the color photothermographic element such that the surface of the element attains a temperature of 65 or 70° C.

11. The method of claim 1 wherein the annealing step is conducted at a relative humidity below 40%.

12. The method of claim 1, wherein the annealing step is conducted at a relative humidity within the range of 0 to 25% relative humidity.

13. The method of claim 1 wherein the photothermographic element, after annealing, is allowed to return to ambient temperature and relative humidity, and then is packaged in a vapor impermeable barrier.

14. The method of claim 1 wherein the annealing step occurs after the coating and drying of some or all of the imaging layers onto a support.

15. The method of claim 1 wherein the annealing step occurs when the photothermographic element is in the form of a continuous web in a commercial manufacturing operation.

16. The method of claim 1 wherein the annealing step occurs when the photothermographic element is a sheet comprising a plurality of consumer imaging elements.

17. The method of claim 1 wherein the annealing step occurs when the photothermographic element is in the form of a single-unit consumer-imaging color-negative film element.

18. The method of claim 1 wherein the annealing step occurs by contacting the surface of the photothermographic element with a heated surface.

19. The method of claim 18 wherein the heated surface is a continuous drum processor.

20. The method of claim 17 wherein the annealing step occurs by means of convection-type air heating.

* * * * *